United States Patent [19]

Klein

[11] Patent Number: 4,905,392

[45] Date of Patent: Mar. 6, 1990

[54] ADHESIVE BACKED BUSINESS CARD FOR MOUNTING ON FILE CARD

[76] Inventor: Gerald B. Klein, 13451 Stuart Ct., Broomfield, Colo. 80020

[21] Appl. No.: 177,375

[22] Filed: Apr. 4, 1988

[51] Int. Cl.[4] ..... G09F 3/10

[52] U.S. Cl. ..... 40/638; 40/360; 281/5

[58] Field of Search ..... 40/594, 360, 373, 390, 40/638, 404, 299, 383; 283/101, 103, 105, 62, 61; 402/79, 500; 428/43; 281/5; D19/1, 9, 10

[56] References Cited

U.S. PATENT DOCUMENTS

| | | | |
|---|---|---|---|
| 2,321,184 | 6/1943 | Butterworth | 283/101 |
| 2,521,435 | 9/1950 | Wockenfuss | 281/5 |
| 2,805,816 | 9/1957 | Morgan | 40/299 |
| 3,304,102 | 2/1967 | Huffman | 281/5 |
| 4,165,575 | 8/1979 | Neilson | 40/379 |
| 4,636,179 | 1/1987 | Gentile et al. | 283/56 |

*Primary Examiner*—Cary E. Stone
*Attorney, Agent, or Firm*—Dennis O. Kraft

[57] ABSTRACT

A technique by which business or calling cards of standard dimensions can be retained and displayed in conventional file or address card systems of the type which utilize a file card that has an available and usable surface area which, in at least one dimension, is smaller than that of the business card. The business card has a contact adhesive back surface normally covered by a release sheet which is adapted to be removed when the card is to be mounted on a file card. The card itself is score-cut about its edge portion to provide a rectangular lift-out panel whch carries all of the printed information, which lift-out panel is smaller than the original business card and is proportioned to properly fit the available usable surface area of the file card upon which the panel is thereafter adhesively affixed.

2 Claims, 5 Drawing Sheets

ADHESIVE BACKED BUSINESS CARD FOR MOUNTING ON FILE CARD

BACKGROUND OF THE INVENTION

This invention relates to information storage devices and is more particularly concerned with the construction of an adhesive backed business or calling card and a file card whereon the business card is mounted for effectively retaining, displaying, and storing business and calling cards.

Many file card systems are available for use in storing, indexing, and retrieving information such as names, addresses, telephone numbers and the like. Typically, the user of such file card systems is required to remove a particular file or index card, and either print or type information upon same, the file or index card thereafter being reinserted into its holder or frame therefor. These conventional file card systems do not readily accommodate persons who may receive business or calling cards and the like (all such cards being generically referred to hereinafter as "business cards"), which persons may desire to not only file the information on such business cards, but to retain the business cards per se. Such a person is required to remove a conventional file or index card from its frame or holder and print or type thereon the information obtained from a business card, with the business cards being thereafter stored in a haphazard fashion.

In the typical business setting, the transfer of information from a business card to a file or index card therefore requires a significant amount of effort, so much so that same is oftentimes overlooked. Further, the retention and storage of business cards is quite unorganized and such business cards are readily misplaced as a result.

BRIEF SUMMARY OF THE INVENTION

A need clearly exists for a mechanism or system which eliminates the typical problem of haphazard storage of business cards and, at the same time, assures that the information on such business cards is readily and effectively available for storage and retrieval. It is the primary objective of the instant invention to provide an apparatus which satisfies this need, an apparatus which serves to readily and efficiently retain and display business cards.

A further objective of the present invention concerns the provision of an apparatus which can markedly reduce the work effort involved in transferring pertinent information from a business card onto a file or index card.

Yet another objective of the instant invention is the provision of an apparatus which allows a business card to be directly affixed to a file or index card, thus eliminating the opportunity for a typist or secretary to make an error in transcribing information from the business card to the file or index card.

These as well as other objectives are implemented by the instant invention which, as aforementioned, is directed to the provision of an adhesive-backed business card which may be affixed to a file or index card which may, in turn, be carried in a frame means capable of holding a multiplicity of filed cards. Business cards and file cards are in extensive use throughout the country and, to a great extent, have become standardized in size and form. Thus, it becomes essential that the attachment of a business card to a file card be accomplished without requiring a variation of one or the other from a standardized size.

The difficulty in accomplishing this is clearly demonstrated by comparing the size of a standard business card with the size of a most popular file card of the type which is commonly carried upon a card-holding frame means. A common business card is 3½ inches wide by 2 inches high. The popular file card has a usable face surface which is 4 inches wide and 1¾ inches high. Unless the business card is trimmed, it will not fit on the file card.

In essence, the present invention solves this problem by providing a business card having a contact-adhesive back surface normally covered by a release sheet which is to be removed when the card is to be mounted. The release sheet actually carries the business card, and the card is score-cut about its edge portion to provide a rectangular lift-out panel no more than 1¾ inches high and is proportioned to properly fit the available usable surface of the popular file card. All of the printed information on the business card is in the lift-out panel and thus, the lift-out panel forms a novel and useful combination with the popular sized file card in a simple, effective manner.

BRIEF DESCRIPTION OF THE DRAWINGS

The invention itself will be better understood, and further features and advantages thereof will become apparent from the following detailed description of a preferred inventive embodiment, such description making reference to the appended sheets off drawings wherein.

DETAILED DESCRIPTION OF THE INVENTION

Figure 1:
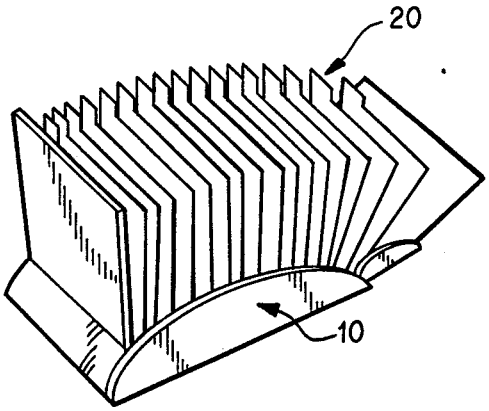
FIG. 1 is a perspective illustration of a file or index card displaying apparatus constructed in the form of a tray or box.

With reference now to the drawings, and particularly to FIG. 1 thereof, one form of an apparatus is disclosed suitable for use in retaining and displaying business cards. The apparatus will be seen to comprise a frame means or card holder generally designated by reference numeral 10 adapted to receive and hold a multiplicity of planar sheets generally designated by reference numeral 20 which comprise file or index cards constructed in the manner depicted in FIG. 3, for example.

Figure 2:
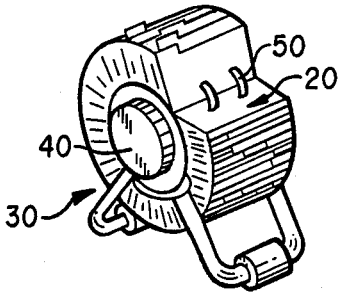
FIG. 2 is a perspective illustration of a file or index card displaying apparatus constructed in the form of a rotary "flip-file"

An alternative construction of a frame means is that depicted in FIG. 2 of the appended drawings, wherein the frame means 30 therein is constructed as a rotary "flip-file" containing a central wheel 40 having rods or channels 50 disposed thereon so as to hold the multiplicity of file or index cards 20 therein. As the rotary wheel 40 is turned, the multiplicity of file or index cards "flip" and the information upon each card is readily visible to the user. Frame means such as is shown in FIGS. 1 and 2 are generally known to the public and can be obtained from most office supply sources.

Figure 3:
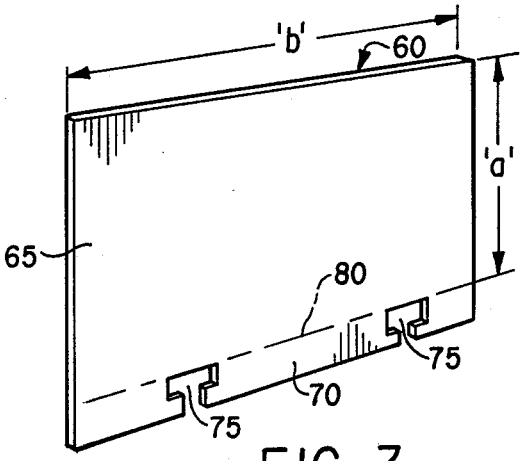
FIG. 3 is a perspective illustration of a file or index card suitable for use with the present invention.

With reference now to FIG. 3 of the application drawings, a typical planar sheet 60 constituting a file or index card is shown, the card being constructed of relatively stiff paper material. The card has a plane, flat surfaces consisting of two portions, an information carrying surface 65 and a mounting edge means 70 wherein means such as slots 75 may be provided for removably attaching the planar sheet or card 60 to the frame means 10 or 30 as in FIGS. 1 or 2. The mounting edge means 70 can include attaching means other than slots 75, such as tabs, for example (not shown). The dashed line 80 between the information carrying surface 65 and the mounting edge means 70 defines the extent of the height 'a' of the information carrying surface which on a popular sized file card 60 is $1\frac{3}{4}$ inches high. The width 'b' of the card is normally 4 inches.

Figure 4:
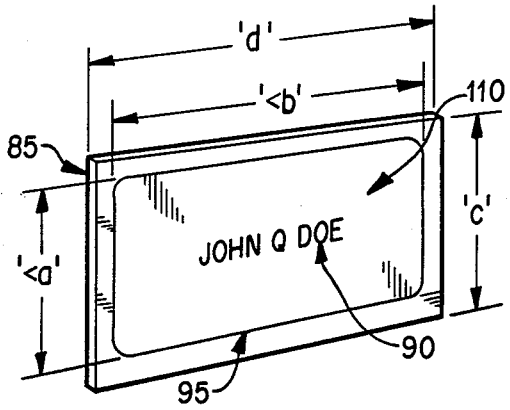
FIG. 4 is a perspective illustration of a common business card as used in the present invention.
Figure 5:
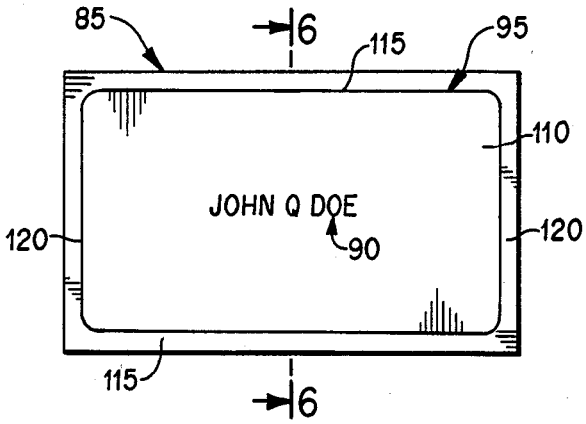
FIG. 5 is an elevational view of the business card shown in FIG. 4 but with a face score-cut being specifically illustrated.

FIGS. 4 and 5 of the drawings show a typical business card 85, also constructed of a relatively stiff paper material and having a suitable legend 90 printed thereon. The height 'c' of card 85 is standardized at 2 inches and the width 'd' is $3\frac{1}{2}$ inches. A score-cut 95 is formed about the card as hereinafter further described.

Figure 6:
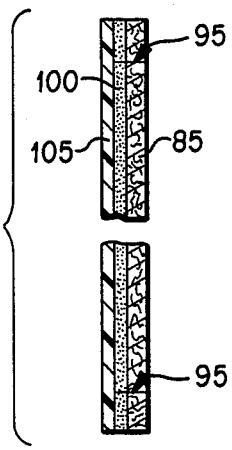
FIG. 6 is a transverse section of the card as taken from the indicated line 6—6 in FIG. 5 but on a greatly enlarged scale and with the center portion broken away to conserve space.

Referring to FIG. 6 of the drawings, the business card is formed with a contact adhesive 100 at it back surface which is protected by a release sheet 105 when the card is used for general purposes wherein it need not be placed in a file. Contact adhesives and release sheets are well known in the art and need not be further described.

The score-cut 95 is sized to permit the lift-out panel 110 to fit the usable face surface 65 of the file card 60. The vertical space between the horizontal line portions 115 must not be more and preferably is slightly less than the height 'a' of the usable face surface 65, indicated as '<a' in FIG. 4. The horizontal space between the vertical line portions 120 must not be more, and preferably is slightly less than the width 'b' of the usable face surface 65, indicated as '<b' in FIG. 4. In the standard file card 60, the width 'b' is 4 inches and in a standard business card, the width 'd' is $3\frac{1}{2}$ inches; hence the vertical portions 120 of the score-cut 95 are unnecessary and the panel 110 may, if desired, extend to the sides of the business cards.

Figure 7:
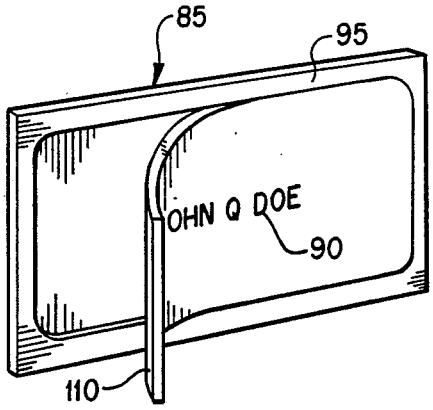
FIG. 7 is a perspective illustration similar to FIG. 4 but with the lift-out panel of the business card being partially removed.
Figure 8:
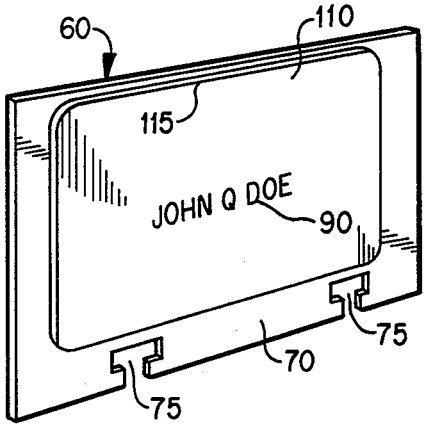
FIG. 8 is a perspective illustration similar to FIG. 3 but showing the lift-out panel being mounted upon the file card.

The application of the lift-out panel 110 of the business card 85 to the file card 60 is very simple. As shown in FIG. 7, this panel 110 may be lifted from the business card 85 and simply affixed to the usable surface 65 of the file card 60 as shown in FIG. 8. It is to be noted that the panel 110 may also be used with file cards larger than the file card 60 herein described.

Figure 9:
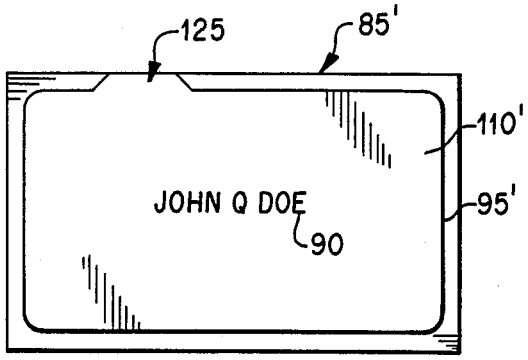
FIG. 9 is an elevational view similar to FIG. 5 but showing the score-cut modified to provide a tab.
Figure 10:
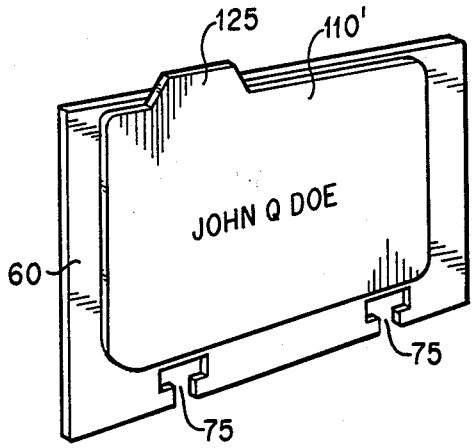
FIG. 10 is a perspective illustration similar to FIG. 8 but showing the card of FIG. 9 mounted upon the file card with the index tab projecting therefrom.

FIGS. 9 and 10 show a slight modification of the invention wherein a business card 85' is formed with a modified score-cut 95' to provide a panel 110' having a protruding tab 125 to function as an index tab or the like. When the panel 110' is removed and placed on the file card 60, the tab 125 will protrude above the file card 60 as shown in FIG. 10. It would be desirable to keep the adhesive off the area forming the tab 125. This can be accomplished by leaving a strip of the back side of the card uncoated, ie. with no adhesive, this strip being either horizontal or vertical and which intercepts the tab.

Figure 11:
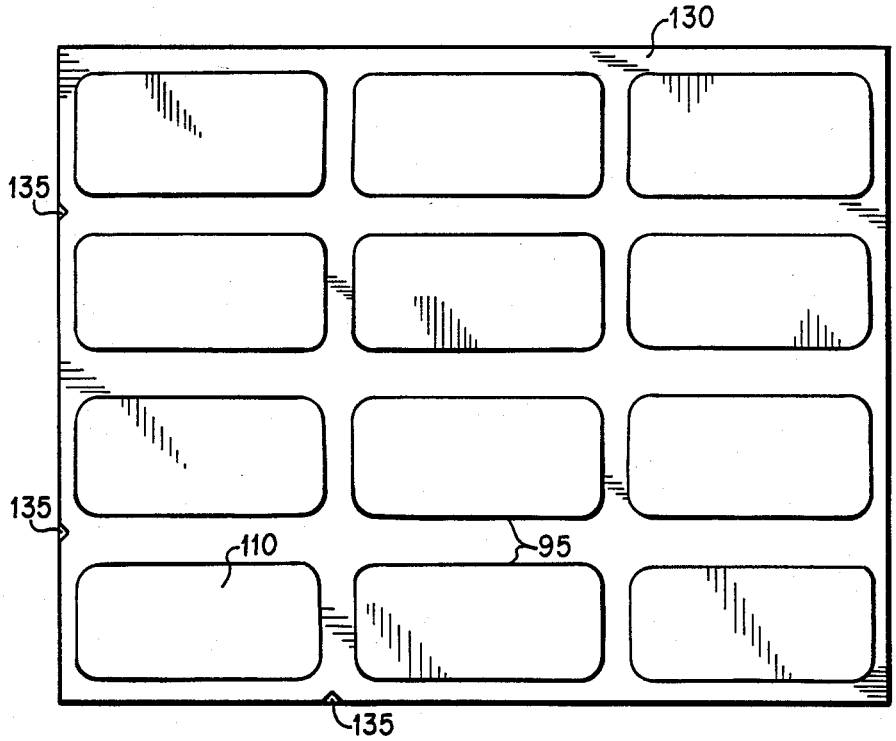
FIG. 11 shows a stock sheet of business cards having a plurality of scores marked thereon suitable for supply to a printer.
Figure 13:
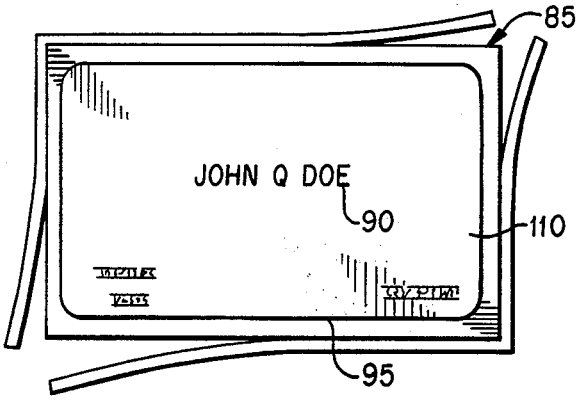
FIG. 13 shows a printed card trimmed to size.
Figure 12:
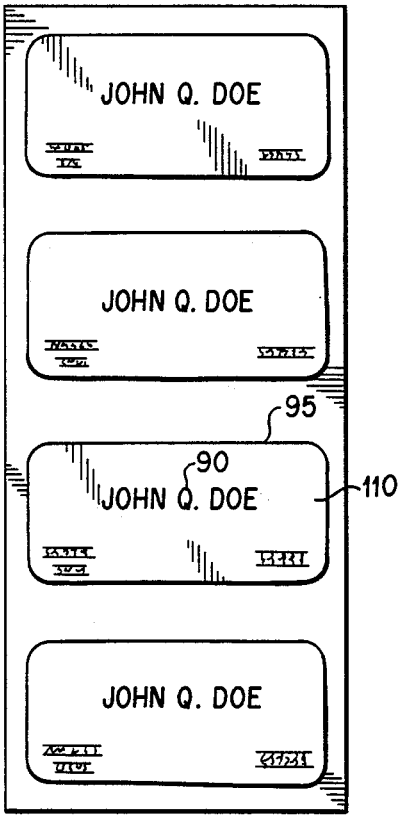
FIG. 12 shows a portion of the sheet of FIG. 11 cut to a convenient size by the printer with custom printing thereon.

With reference now to FIGS. 11 through 13, a manufacturing or assembly technique is depicted. Finished business card stock supplied by the manufacturer will include paper card stock with the contact adhesive 100 at the back side, a protective release sheet 105, and the score lines 85 defining the lift-out panels. The paper card stock may be furnished as $8\frac{1}{2}$ by 11 inch sheets which are suitable for printing a dozen cards. Other convenient sizes may also be furnished as desired. In accordance with the invention, the positioning of the cards on the sheet is predetermined. For example, FIG. 11 shows an $8\frac{1}{2}$ by 11 inch sheet 130 wherefrom twelve conventionally sized 2 by $3\frac{1}{2}$ inch business cards may be produced with a minimum of edge loss. The panels 110 on this sheet may be scored simultaneously by a gang die with the sheet being precisely positioned by registration marks 135 at the edges of the sheet.

When the printer receives this sheet, he may first divide it to a size convenient to his particular printing operation, as shown in FIG. 12. He will custom print the cards with a suitable legend 90. Finally, he will trim the printed cards to a conventional 2 by $3\frac{1}{2}$ inch size as shown in FIG. 13.

In use, a business card formed as described herein is affixed to a file or index card, which file or index card would then be placed within the frame means or holding mechanisms 10 or 20. No laborious transfer of information from the business cards to the file or index cards is required, and the business cards are safely stored in a well-organized manner.

It should now be recognized that the objectives set forth at the outset of this specification have been successfully achieved.

What is claimed is:

1. A method of mounting and displaying a planar and generally rectangular business card in a file card system of the type having a multiplicity of file cards retained in a frame means therefor, each file card having four sides and incorporating two adjacent planar surface portions which are generally rectangular in shape, one such surface portion being disposed along one side of the file card and defining a mounting edge means by which the file card is removably attached to the frame means, the other surface portion being delimited by the remaining three sides of the file card and by said mounting edge means and defining an information-carrying surface area, the information-carrying surface area having at least one dimension that is less than the corresponding dimension of the business card such that the business card, when juxtaposed with a file card, is larger in extent than, and cannot fit within the confines of, the information-carrying surface area of the file card, the method comprising the steps of: providing an adhesively-backed removable panel in the business card, which panel is not greater in extent in any planar dimension than the corresponding planar dimension of the information-carrying surface area of the file card, the removable panel bearing business card information in the form of printed indicia; lifting the removable panel from the business card; and adhesively affixing the removable panel on and within the confines of the information-carrying surface area of the file card.

2. The method defined in claim 1, wherein the dimensions of the information-carrying surface area of the file card are nominally 4 inches by $1\frac{3}{4}$ inches and the dimensions of the business card are nominally $3\frac{1}{2}$ inches by 2 inches.

* * * * *